US005234052A

United States Patent [19]

Coone et al.

[11] Patent Number: 5,234,052

[45] Date of Patent: Aug. 10, 1993

[54] CEMENTING APPARATUS

[75] Inventors: Malcolm G. Coone, Katy; Frank Cole, Sugar Land, both of Tex.

[73] Assignee: Davis-Lynch, Inc., Houston, Tex.

[21] Appl. No.: 877,402

[22] Filed: May 1, 1992

[51] Int. Cl.[5] ..... E21B 33/16

[52] U.S. Cl. ..... 166/155; 166/156; 166/192; 166/242

[58] Field of Search ..... 166/153, 154, 155, 156, 166/242

[56] References Cited

U.S. PATENT DOCUMENTS

| | | | |
|---|---|---|---|
| 3,550,683 | 12/1970 | Comeaux | 166/156 |
| 4,190,111 | 2/1980 | Davis | 166/153 X |
| 4,711,300 | 12/1987 | Wardlaw, III et al. | 166/153 |
| 4,836,279 | 6/1989 | Freeman | 166/153 |
| 4,858,687 | 8/1989 | Watson | 166/153 |
| 4,979,562 | 12/1990 | Langer | 166/156 X |
| 5,025,858 | 6/1991 | Glaser | 166/153 X |
| 5,095,980 | 3/1992 | Watson | 166/153 X |
| 5,113,940 | 5/1992 | Glaser | 166/156 |

*Primary Examiner*—Ramon S. Britts
*Assistant Examiner*—Frank S. Tsay
*Attorney, Agent, or Firm*—Vaden, Eickenroht, Thompson, Boulware & Feather

[57] ABSTRACT

There is disclosed an assembly of parts for use in cementing a casing string in a well bore comprising a float collar connectible as part of the string, a cement plug lowerable onto the collar, and a wiper plug lowerable onto the cement plug, the lower end of the cement plug having threads for limited make-up with threads on the upper end of the collar and the lower end of the wiper plug having threads for limited make-up with the cement plug, so as to limit rotation between them.

16 Claims, 4 Drawing Sheets

CEMENTING APPARATUS

FIELD OF THE INVENTION

This invention relates generally to apparatus for use in the drilling and completion of an oil and/or gas well. More particularly, it relates to improvements in an assembly of parts including a float collar, cement plug and wiper plug used in cementing a casing string within the bore of the well.

It is conventional practice, in the drilling and completion of such wells, to install a float collar in the casing string near its lower end. For this purpose, the collar comprises an outer body connectible as part of the drill string, an inner body having a bore therethrough, and a check valve member mounted in the bore to permit flow downwardly but prevent flow upwardly therethrough. Thus, the collar prevents the string from being filled with drilling fluid as it is "floated" into the well bore.

When the casing string has been lowered to the desired depth, a cement or bottom plug is pumped downwardly through the string by means of a slurry of cement and mud above it to land on the float collar. For this purpose, the cement plug includes a body having lips or wings about it to flexibly engage the inner diameter of the string and a bore therethrough having a frangible diaphragm across it.

With the cement plug landed on the float collar, the pressure of the cement is raised to a level to rupture the diaphragm. A wiper or top plug also including a body having lips about it to flexibly engage the inner diameter of the string is installed in the string above the column of cement slurry and is then pumped downwardly by the pressure of drilling fluid above it so as to force the cement slurry out the lower end of the casing string and upwardly into the annulus between the string and well bore.

DESCRIPTION OF THE RELATED ART

The inner body of the float collar as well as the bodies of the plugs are made of a drillable material which, when the slurry has set up to anchor the string in the well bore, may be drilled out along with the cement by a bit on the lower end of a rotary drill string, to establish a full opening through the string. Although conventional bits having toothed cutting elements permitted the plugs to be drilled out with relative ease, they have been difficult to drill out with more modern drill bits made of polycrystalline diamond compact (PDC). Hence, as disclosed in U.S. Pat. Nos. 4,711,300, 4,836,279 and 4,858,687, it has been proposed to provide the upper end of the float collar and lower end of the cement plug and the upper end of the cement plug and lower end of the wiper plug with matching teeth or lugs intended to prevent relative rotation between them and thus facilitate removal of the drillable materials in response to rotation of the bit.

Except for the weight imposed on the bit, however, this does not discourage vertical vibrations of the plugs, especially since the bit itself will vibrate as it is drilling out the material. Consequently, the cutting operation is inefficient and time-consuming, and the interlocking elements are subject to excessive wear to the point of not deterring rotation. Still further, depending on the height of the interlocking parts, they may not remain engaged.

U.S. Pat. No. 3,550,683 shows a plug of this type having arcuate teeth about its lower end adapted to fit within arcuate slots in the upper end of a float shoe, as the plug is landed on the shoe, and thus are intended to lock the plug against rotation with respect to the collar upon rotation of the bit. Moreover, grooves about the lower end of the plug are apparently intended to latch into matching grooves about the bore of the collar as the teeth are lowered into the slots. Obviously, however, the extent to which the grooves on the plug must be inwardly flexed to engage with those on the collar detract from their ability to hold the plug down. Also, the extent to which the grooves will hold the plug down and prevent its vibration depends on the tolerance between them, which in turn depends on the depth to which the arcuate teeth move downwardly into the slots.

It is therefore the primary object of this invention to provide such an assembly in which the cement and wiper plugs, or, in the absence of the cement plug, the wiper plug, are more securely held against rotation and vibration.

BRIEF DESCRIPTION OF THE DRAWINGS

In the drawings, wherein like reference characters are used throughout to designate like parts.

DESCRIPTION OF THE PREFERRED EMBODIMENT

Figure 1:
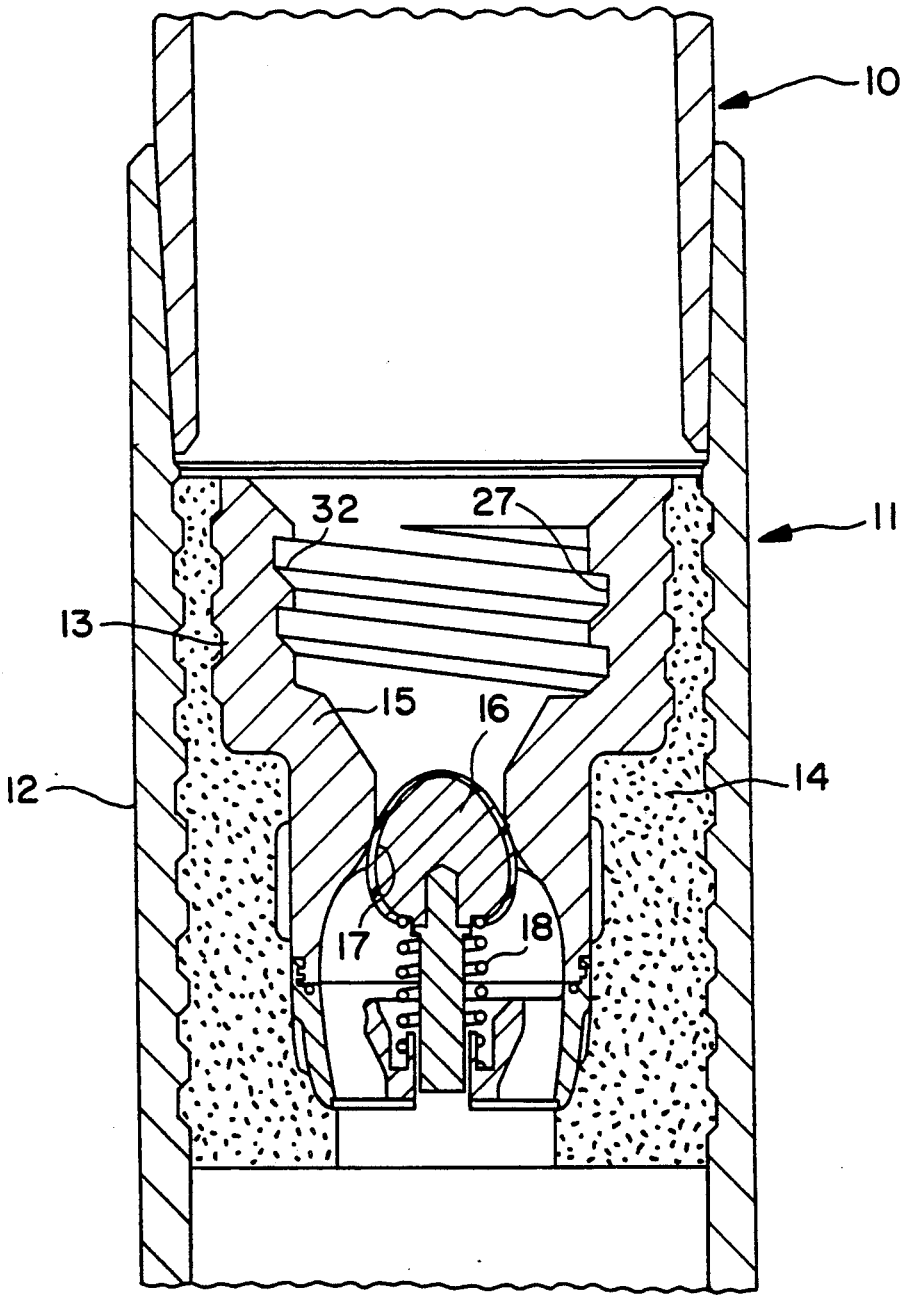
FIG. 1 is a vertical sectional view of a casing string, interrupted along its length, and having a float collar installed therein which is constructed in accordance with an illustrated embodiment of the present invention.
Figure 2:
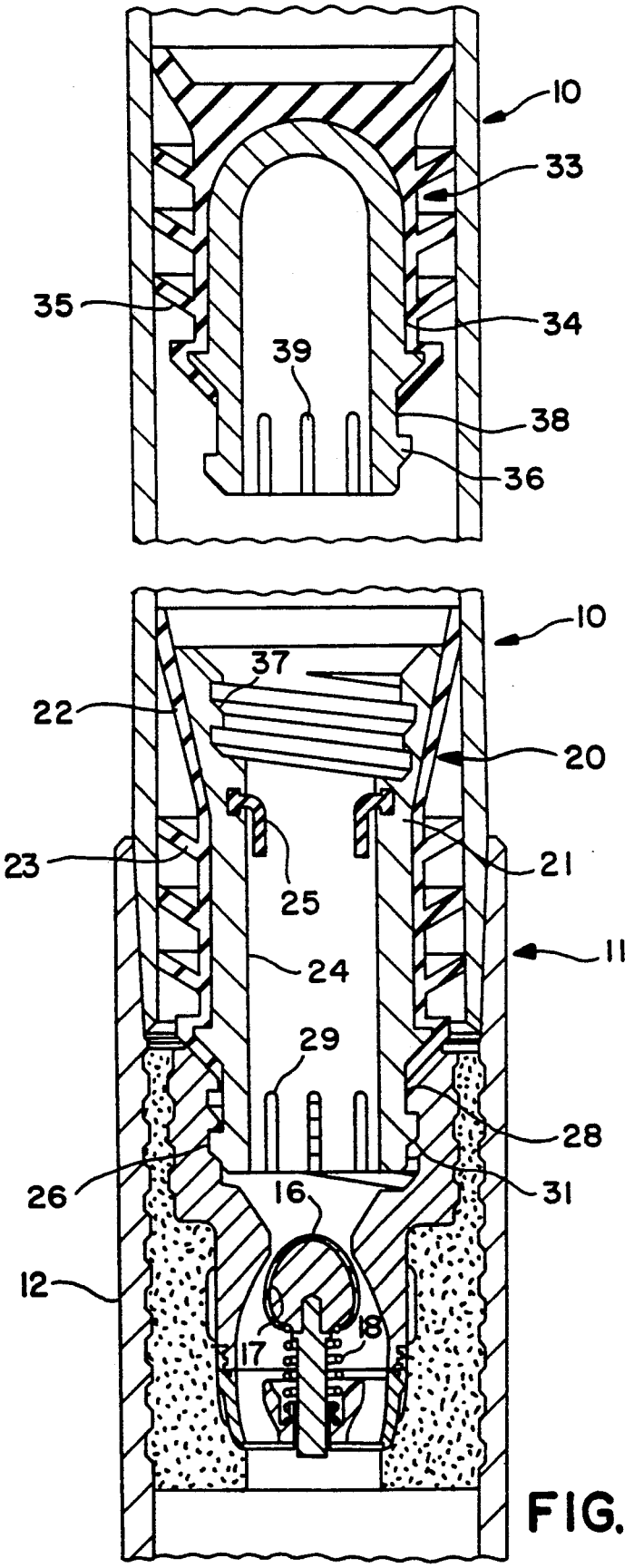
FIG. 2 is a view similar to FIG. 1, but upon lowering of the lower end of a cement plug also constructed in accordance with the present invention into the casing string above the collar to force the column of cement past the check valve in the float collar and thus upwardly into the annulus between the string and well bore, and showing the lower end of the cement plug threadedly made up with the upper end of the float collar, as well as a wiper plug also constructed in accordance with the present invention and during lowering through the casing string above the cement plug so as to pressurize the cement column and thus rupture the diaphragm across the bore of the cement plug.
Figure 3:
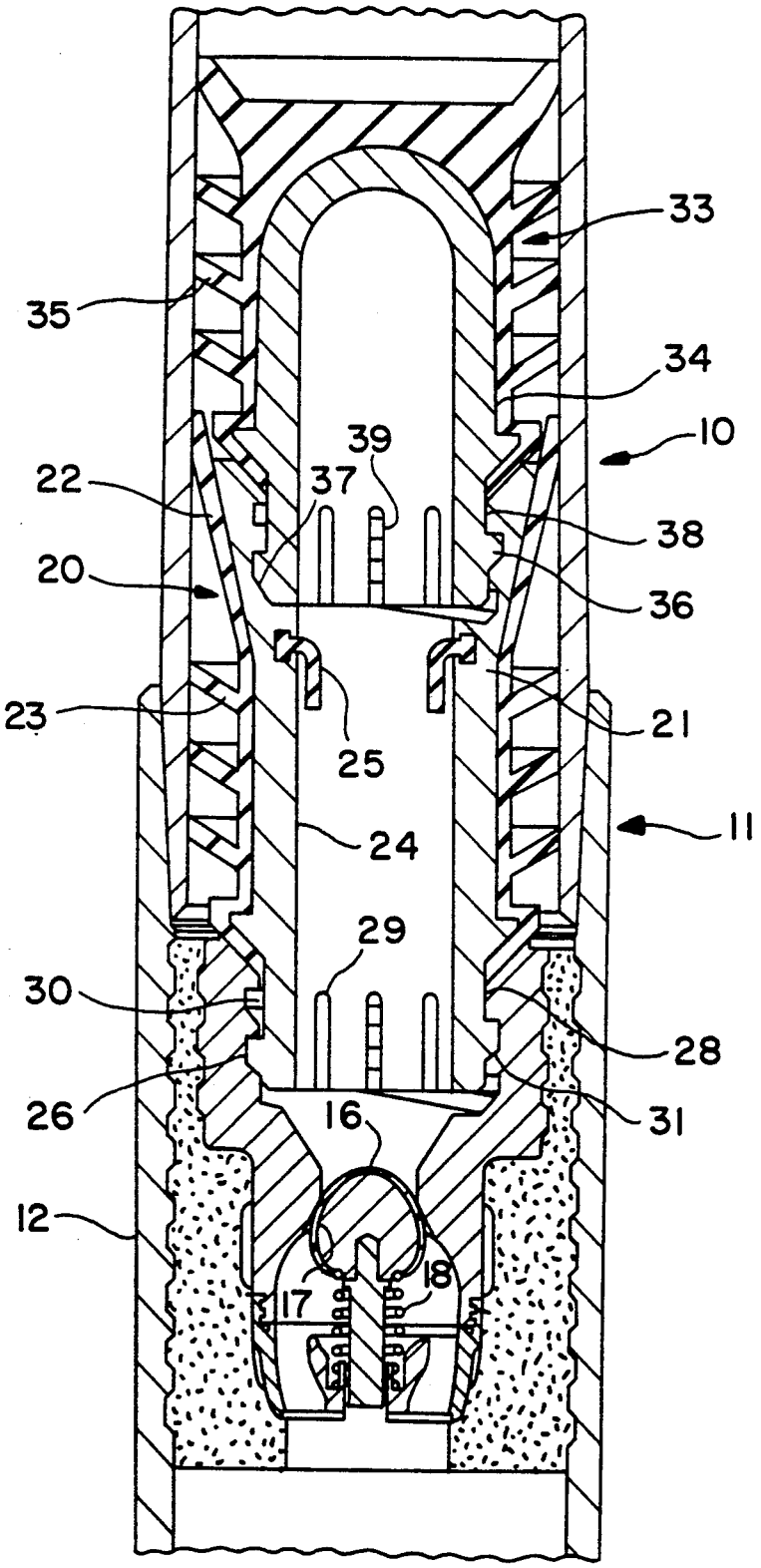
FIG. 3 is another view similar to FIG. 2, but upon landing of the wiper plug upon and threaded engagement of its lower end with the upper end of the cement plug.
Figure 4:
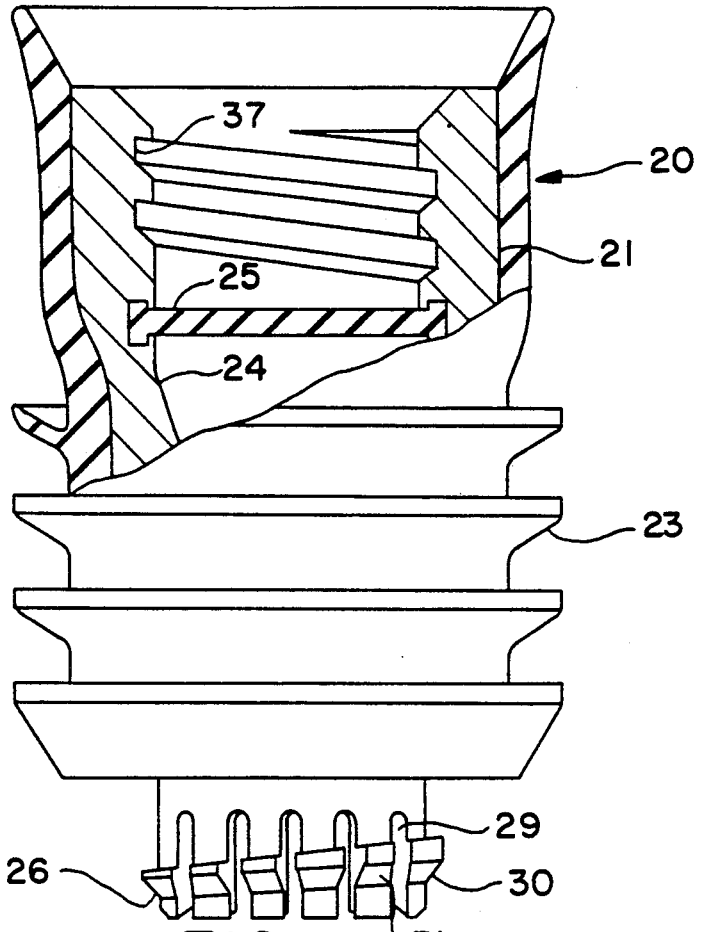
FIG. 4 is a view, partly in section and partly in elevation of the cement plug.
Figure 5:
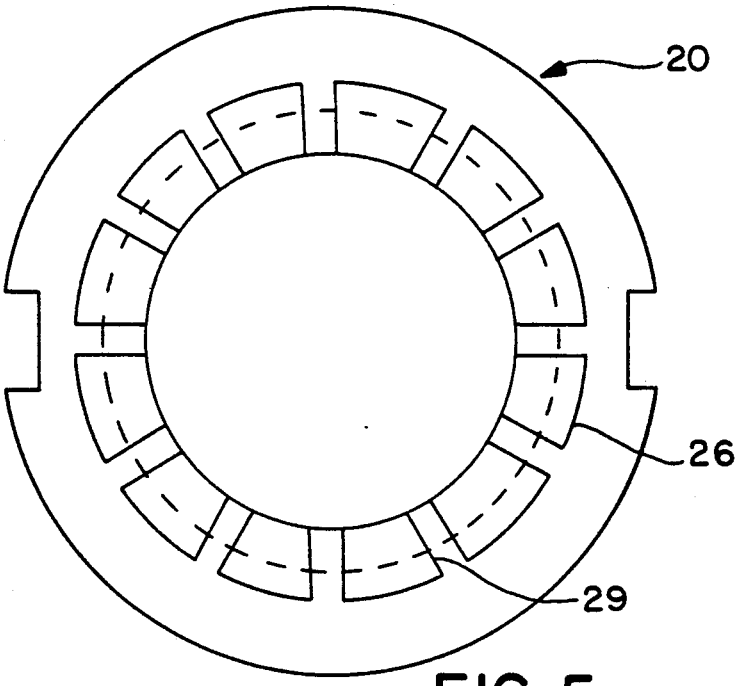
FIG. 5 is a view of the lower end of the cement plug of FIG. 4.

With reference now to the details of the above described drawings, the casing string, indicated in part in each of FIGS. 1, 2 and 3 by reference character 10, is shown to be lowered into the desired depth in the well bore. The float collar constructed in accordance with the present invention, and illustrated in its entirety by reference character 11, includes an outer tubular body 12 threadedly connected at its upper end to the lower end of a joint of the casing string 10 near its lower end. Although not shown, it will be understood that the lower end of the body 12 would in turn be threadedly connected to another joint of the casing string.

The float collar also includes an inner body 13 anchored within the outer body by a short column of cement 14, and having a bore 15 therethrough connecting its upper and lower ends. The bore is adapted to be opened and closed by means of a check valve comprising a poppet-type valve member 16 adapted to be moved vertically between a lower position opening the bore and an upper position closing the bore, thus permitting flow downwardly therethrough, but preventing flow upwardly therethrough. As shown, the poppet is yieldably urged to its upper position by means of a coil spring 18, all in accordance with conventional practice.

The cement or lower plug indicated in its entirety by reference character 20, and shown in FIGS. 2, 3, 4 and 5 includes a tubular body 21 and a sleeve 22 of elastomeric material about the body having annular lips or wings 23 thereabout which are adapted to flexibly engage the inner diameter of the casing string to permit the plug to be pumped downwardly therein in response to fluid pressure above them. Body 21 also has a bore 24 therethrough and, in accordance with conventional practice, a frangible or rupturable diaphragm 25 thereacross.

In accordance with the novel aspects of the present invention, threads 26 are formed on the lower end of the body 21 of the cement plug for limited make-up with threads 27 formed in the upper end of the bore 15 through the inner body in response to right-hand rotation of the cement plug, which, in turn, is responsive to right-hand rotation of a wiper plug above it due to rotation of the drill bit, as will be described to follow. As shown, for example, there are about one and one-half turns of threads 26 for make-up with approximately three threads 27. In the preferred and illustrated embodiment of the invention, the threads are of a semi-buttress type with threads 26 having substantially horizontal upper sides and tapered lower sides, and threads 27 having substantially horizontal lower sides and tapered upper sides.

In accordance with the preferred embodiment of the invention, the threads 26 are formed about a sleeve 28 of reduced outer diameter at the lower end of the body 21 of the cement plug, and slots 29 extend upwardly from the lower end of the sleeve and through the threads to form depending flexible fingers 30 each having a thread segment formed thereon. More particularly, the lower tapered sides 31 of the thread segments permit them to flex inwardly upon sliding downwardly within similarly tapered upper sides 32 of the threads 27. Thus, depending on the rotational orientation of the threads with respect to one another, the fingers will be lowered until they flex inwardly to latch onto the threads in the bore of the float collar.

As the fingers are latched over the threads to hold the cement plug down, a shoulder about the lower end of the plug engages an upwardly facing shoulder on the upper end of the float collar to form a seal between them so that additional pressure will rupture the diaphragm to permit cement to be circulated past the valve and into the annulus. Right-hand rotation of the cement plug will cause the threads on the fingers and in the bore of the float collar to make up with one another in order to more securely lock the shoulder on the plug down on the float collar.

As shown in FIG. 3, the wiper or upper plug, which is indicated in its entirety by reference character 33, has been lowered from the position of FIG. 2 to land on the upper end of the cement or lower plug 20. As shown, the wiper plug includes a body 34 and an elastomeric sleeve about the body having lips or wings 35 thereabout flexibly engagable with the inner diameter of the casing string to permit the wiper plug to be pumped downwardly onto the cement plug. As compared with the body of the cement plug, the body of the wiper plug is imperforate and thus does not permit flow through it.

In any case, the lower end of the body 34 has threads 36 thereabout for limited make-up with threads 37 formed in the upper end of the bore 24 through the body of the cement plug in response to right-hand rotation of the wiper plug with respect to the cement plug. Thus, with the teeth of the cement plug made up with those of the float collar, and the teeth of the wiper plug made up with those of the cement plug, both plugs are prevented from rotation with respect to one another or with respect to the float collar.

Threads 36 of the wiper plug are formed about a sleeve 38 of reduced diameter at the lower end of the body 34. More particularly, and again as in the case of the teeth on the lower end of the cement plug, the sleeve 38 has slots 39 extending upwardly from its lower edge and passing through the teeth so as to form inwardly flexible fingers each having thread segments formed thereon. The teeth on the lower end of the wiper plug and upper end of the cement plug are also similar to those on the lower end of the cement plug and upper end of the float collar in that they are of a semi-buttress type having downwardly and inwardly tapered sides for the purposes previously described. As was also true in the case of the cement plug and float collar, the lower end of the wiper plug has a downwardly facing shoulder thereon adapted to engage an upwardly facing shoulder on the upper end of the cement plug to limit make-up of the wiper plug, and form a seal between them.

Preferably, the cooperating teeth on the lower end of the wiper plug and upper end of the cement plug, and on the lower end of the cement plug and upper end of the float collar, are of the same diameter and configuration that in the event the cement or bottom plug is not used during the cementing operation, the wiper plug may be made up directly with the float collar. This, of course, reduces the inventory that an operator would have to maintain.

Reviewing now the over-all operation involving the use of the above described float collar and cement and wiper plugs, and with the float collar installed in the casing string, as illustrated, the cement plug 20 would be lowered through the casing string onto the upper end of the float collar. As previously described, the cement plug is so lowered by means of a column of cement within the casing string above it. During this time, of course, downward movement of the cement plug will force drilling mud in the casing string downwardly past the check valve and thus into the well bore beneath the casing string and upwardly into the annulus from which it may be removed in the wellhead. More particularly, the wiper plug is installed in the casing string above the column of cement in the casing string so as to permit it to be moved downwardly by the pressure of drilling fluid above it. As this pressure is increased, the diaphragm 25 is ruptured to permit the cement in the column to be circulated past the check valve in the float collar and up into the annulus between the casing string and well bore. When the cement column has been so circulated, the lower end of the wiper plug lands upon the upper end of the cement plug, following which, at a later time, a drill string having a bit at its lower end is lowered into the casing string into engagement with the upper end of the wiper plug. Thus, as well-known in the art, the cement column and inner body of the float collar, as well as the bodies of the cement and wiper plugs, are made of a drillable material so that rotation of the drill string will permit the bit to drill them out and thus provide a full opening through the casing string. As also well-known in the art, this rotation of the drill bit against the upper end of the wiper plug will cause the wiper plug to be initially rotated with the drill bit, which in turn causes the threads on its lower end to be made up with the threads on the upper end of the cement plug, and the threads on the lower end of the cement plug to be made up with the threads on the upper end of the float collar. Thus, the cement column as well as the drillable materials of the collar and plugs are removed as the plugs are made up with one another and the cement plug is made up with the float collar so as to prevent rotation between them.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in cementing a casing string within a well bore, an assembly comprising:

a float collar including an outer body connectible as part of the casing string and an inner body having a bore therethrough having upper and lower ends and a valve member in the bore to permit flow downwardly and prevent flow upwardly therethrough, a cement plug including a body having a bore therethrough and upper and lower ends with a frangible diaphragm thereacross and lips thereabout flexibly engagable with the casing string to permit the plug to be prepared downwardly onto the float collar, the upper end of the bore of the float collar having threads thereon and the lower end of the body of the cement plug having threads thereabout for limited make-up with the threads in the bore of the float collar in response to rotation of the cement plug in one direction, and a wiper plug comprising a body having lips thereabout flexibly engagable with the casing string to permit the wiper plug to be pumped downwardly onto the cement plug, the upper end of the bore of the cement plug having threads thereon and the lower end of the bore of the body of the wiper plug having threads thereabout for limited make-up with the threads in the bore of the cement plug in response to rotation of the wiper plug in said one direction, and the inner body of the float collar and the bodies of the cement and wiper plugs being of a drillable material.

2. An assembly as described in claim 1, wherein the lower end of the cement plug comprises a sleeve adapted to fit closely within the upper end of the bore of the float collar and has slots extending upwardly through the threads to form flexible fingers having thread segments adapted to latch over the threads in the bore of the float collar as said sleeve is forced downwardly into said bore, and the lower end of the wiper plug comprises a sleeve adapted to fit closely within the upper end of the bore of the float collar and having slots extending upwardly through the threads to form flexible fingers having thread segments adapted to latch over the threads in the bore of the float collar as said sleeve is forced downwardly into said bore.

3. An assembly as described in claim 1, wherein the body of the cement plug has a circumferential shoulder engagable with a circumferential seat on the float collar to limit make-up of their threads and form a seal between them external to the threads, and the body of the wiper plug has a circumferential shoulder engagable with a circumferential seat on the inner body of the cement plug to limit make-up of their threads and form a seal between them external to the threads.

4. An assembly as described in claim 1, wherein the threads on the lower end of the wiper plug are also adapted for limited make-up with the threads in the bore of the float collar in the event the cement plug is not used.

5. For use in cementing a casing string within a well bore, an assembly comprising:

a cement plug including a body having a bore therethrough with upper and lower ends and a frangible diaphragm thereacross and lips thereabout flexibly engagable and the casing string to permit the plug to be pumped downwardly onto a float collar installed as part of the casing string, the lower end of the body of the cement plug having threads thereabout for limited make-up with threads on the float collar in response to rotation of the cement plug in one direction, and a wiper plug comprising a body having upper and lower ends and lips thereabout flexibly engagable with the casing string to permit the wiper plug to be pumped downwardly onto the cement plug, the upper end of the bore of the cement plug having threads thereon and the lower end of the bore of the body of the wiper plug having threads thereabout for limited make-up with the threads in the bore of the cement plug in response to rotation of the wiper plug in said one direction, and the bodies of the cement and wiper plugs being of a drillable material.

6. An assembly as described in claim 5, wherein the lower end of the cement plug comprises a sleeve adapted to fit closely within the upper end of a bore through the float collar and having slots extending upwardly through the threads to form flexible fingers having thread segments adapted to latch over the threads in the bore of the float collar as said sleeve is forced downwardly into said bore, and the lower end of the wiper plug comprises a sleeve adapted to fit closely within the upper end of the bore of the cement collar and having slots extending upwardly through the threads to form flexible fingers having thread segments adapted to latch over the threads in the bore of the cement collar as said sleeve is forced downwardly into said bore.

7. An assembly as described in claim 5, wherein the body of the cement plug has a circumferential shoulder engagable with a circumferential seat on the float collar to limit make-up of their threads and form a seal between them external to the threads, and the body of the wiper plug has a circumferential shoulder engagable with a circumferential seat on the body of the cement plug to limit make-up of their threads and form a seal between them external to the threads.

8. For use in cementing a casing string within a well bore, a float collar comprising:

an outer body connectible as part of the casing string and an inner body having a bore therethrough with upper and lower ends and a valve member in the bore to permit flow downwardly and prevent flow upwardly therethrough;

the upper end of the bore of the float collar having threads thereon with which threads about the lower end of a cement plug may be made up in response to rotation of the cement plug.

9. For use in cementing a casing string within a well bore, a cement plug comprising:

a body having upper and lower ends and a bore therethrough with a frangible diaphragm thereacross and lips thereabout flexibly engagable with the casing string to permit the plug to be pumped downwardly onto a float collar connected as part of the casing string, the lower end of the body having threads thereabout for limited make-up with threads on the float collar, and the upper end of the bore of the cement plug having threads thereabout for limited make-up with threads about the lower end of a wiper plug lowered onto the cement plug.

10. An assembly as described in claim 9, wherein the lower end of the body comprises a sleeve adapted to fit closely within the upper end of a bore through the float collar and having slots extending upwardly through the threads to form flexible fingers having thread segments adapted to latch over the threads in the bore of the float collar as said sleeve is forced downwardly into said bore.

11. For use in cementing a casing string within a well bore, a wiper plug comprising:

a body having upper and lower ends and lips thereabout flexibly engagable with the casing string to permit the wiper plug to be pumped downwardly onto a cement plug in the casing string, the lower end of the body having threads thereabout for limited make-up with threads in a bore of the cement plug in response to rotation of the wiper plug.

12. A wiper plug as described in claim 11, wherein the lower end of the body comprises a sleeve adapted to fit closely within the upper end of a bore through the cement plug and having slots extending upwardly through the threads to form flexible fingers having thread segments adapted to latch over the threads in the bore of the cement plug as said sleeve is forced downwardly into said bore.

13. For use in cementing a casing string within a well bore, a float collar comprising an outer body connectible as part of the casing string and an inner body having a bore therethrough and a valve member in the bore to permit flow downwardly and prevent flow upwardly therethrough, and a plug comprising a body having lips thereabout flexibly engageable with the casing string to permit the plug to be pumped downwardly onto the float collar, the upper end of the bore of the float collar having threads thereon and the lower end of the plug having threads thereon adapted for limited make-up with those of the float collar in response to rotation of the plug when pumped downwardly onto the float collar.

14. As in claim 13, wherein the lower end of the plug body comprises a sleeve adapted to fit closely within the upper end of the bore through the float collar and having slots extending upwardly through the threads to form flexible fingers having thread segments adapted to latch over the threads in the bore of the float collar as said sleeve is forced downwardly into said bore.

15. As in claim 13, wherein the plug is a cement plug with a frangible diaphragm across a bore through its body, and the upper end of the bore of the cement plug has threads thereabout for limited make-up with which threads about the lower end of a wiper plug adapted to be lowered onto the cement plug.

16. As in claim 13, wherein the body of the plug has a circumferential shoulder engagable with a circumferential seat on the float collar to limit make-up of their threads and form a seal between them external to the threads.

* * * * *